US006733359B1

(12) United States Patent
Jacobs

(10) Patent No.: US 6,733,359 B1
(45) Date of Patent: May 11, 2004

(54) TALKING ACTION FIGURE HAVING FACIAL EXPRESSIONS

(75) Inventor: Warren Leigh Jacobs, London (GB)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/431,287

(22) Filed: May 7, 2003

(51) Int. Cl.[7] ..... A63H 3/28
(52) U.S. Cl. ..... 446/300; 446/391
(58) Field of Search ..... 446/297, 298, 446/299, 300, 301, 302, 303, 321, 391

(56) References Cited

U.S. PATENT DOCUMENTS

| | | | | |
|---|---|---|---|---|
| 4,232,478 A | | 11/1980 | Terzian | |
| 4,244,139 A | | 1/1981 | Erickson et al. | |
| 4,775,352 A | | 10/1988 | Curran et al. | |
| 4,808,142 A | | 2/1989 | Berliner | |
| 4,950,200 A | * | 8/1990 | Curran | 446/302 |
| 5,376,038 A | * | 12/1994 | Arad et al. | 446/297 |
| 5,413,516 A | | 5/1995 | Lam | |
| 6,071,169 A | * | 6/2000 | Cook | 446/300 |
| 6,110,001 A | | 8/2000 | Chae | |

* cited by examiner

*Primary Examiner*—Jacob K. Ackun, Jr.
(74) *Attorney, Agent, or Firm*—Marshall, Gerstein & Borun LLP

(57) ABSTRACT

An action figure having synchronized speech and facial expressions comprises a body defining an internal cavity, a head attached to the body and being deformable into a plurality of facial expressions, and an electrical circuit disposed within the cavity and operatively coupled to a sound generator. The electrical circuit and the sound generator output an audible first speech mode and an audible second speech mode. An actuator operatively coupled to both the head and the electrical circuit is arranged to synchronize the first speech mode with a first facial expression and to synchronize the second speech mode with a second facial expression.

27 Claims, 12 Drawing Sheets

TALKING ACTION FIGURE HAVING FACIAL EXPRESSIONS

BACKGROUND OF THE INVENTION

The present invention is directed to a talking action figure toy having a speech patterns that correspond to facial expressions.

Action figures and similar toys are known in the art. Many such action figures have experienced commercial success, and manufacturers continually search for ways to enhance the play value of such action figures by providing novel features and/or various accessories. For example, U.S. Pat. No. 5,413,516 to Lam discloses a toy doll with lips that move as speech sounds are created. Upon activation of a circuit an electrical motor is activated which turns a drive shaft and gear train, thus causing the lips of the doll to move in an attempt to simulate speech. U.S. Pat. No. 6,110,001 to Chae discloses a toy doll having a deformable face that moves in response to movement of a operating device.

SUMMARY OF THE INVENTION

In one aspect, an action figure having synchronized speech and facial expressions comprises a body defining an internal cavity, a head attached to the body, the head being deformable and having a plurality of facial expressions, an electrical circuit disposed within the cavity and operatively coupled to a sound generator, the electrical circuit arranged for connection to a power source, the electrical circuit and the sound generator arranged to output an audible first speech mode and an audible second speech mode, and an actuator assembly mounted to the body and operatively coupled to both the head and the electrical circuit, the actuator assembly shiftable between a plurality of positions, the actuator assembly arranged to synchronize the first speech mode with a first facial expression and to synchronize the second speech mode with a second facial expression.

By using a single, dual action input button, a user can control both the speech modes and the facial expressions. For example, a first speech mode may mimic normal speech, and corresponds to a first facial expression, such as the mouth of the figure being partially open. A second speech mode may mimic excited speech or yelling, and may correspond to a second facial expression, such as the mouth of the figure being more completely open. Additionally, the second facial expression may include deformed eyebrows, or other features typically indicative of excited or yelling speech.

The actuator assembly may include a rod shiftably disposed within the body and the head may include a pivot lever, with an upper part of the rod operatively engaging the pivot lever. Thus, the pivot lever is shiftable between a first position corresponding to the first facial expression and a second position corresponding to the second facial expression in response to movement of the rod. Preferably, the head includes a flexible skin, and the pivot lever engages the flexible skin. Still preferably the head includes a third facial expression.

The actuator assembly may include a shiftable input button and a shiftable rod, with the rod shiftable in response to movement of the button, the rod operatively connected to the head such that movement of the rod changes the head between the plurality of facial expressions. The button and the rod are moveable to an unshifted position and the head includes a third facial expression corresponding to the unshifted positions of the button and the rod.

The electrical circuit includes an inactive mode, and the head includes a third facial expression corresponding to the inactive mode. A first switch and a second switch may be disposed within the body and operatively coupled to the electrical circuit, the first switch arranged to activate the first speech mode and the second switch arranged to activate the second speech mode. The actuator assembly includes a input button assembly, with the button assembly including a first surface arranged to trigger the first switch in response to movement of the button assembly a first distance, the button assembly including a second surface arranged to trigger the second switch in response to movement of the button assembly a second distance. Both a first input button and a second input button may be provided, and the second input button may be nested within the first input button. The rod may be shiftable within the body and arranged to shift from a rest position to a first shifted position and to a second shifted position, and the head includes a first pivot lever and a second pivot lever operatively engaged by the rod. At least one of the first and second pivot levers is arranged to pivot in response to movement of the rod to the first shifted position, the first shifted position corresponding to the first facial expression, the first and second pivot levers arranged to pivot in response to movement of the rod to the second shifted position, the second shifted position corresponding to the second facial expression. The head preferably includes a deformable skin having a jaw and a forehead area, with the first pivot lever attached to the jaw, the second pivot lever attached to the forehead area.

In another aspect of the invention, an action figure toy comprises a body defining an internal cavity, and a head attached to the body, the head including a deformable skin and a lever engaging the skin, with the skin being deformable in response to movement of the lever such that the skin may be positioned in a plurality of facial expressions. An actuator is moveably mounted within the body and operatively connected to the lever, and an input button is mounted to the body and is operatively connected to the actuator. The input button is shiftable to a first position corresponding to a first facial expression and to a second position corresponding to a second facial expression.

DETAILED DESCRIPTION OF VARIOUS EMBODIMENTS

Figure 1:
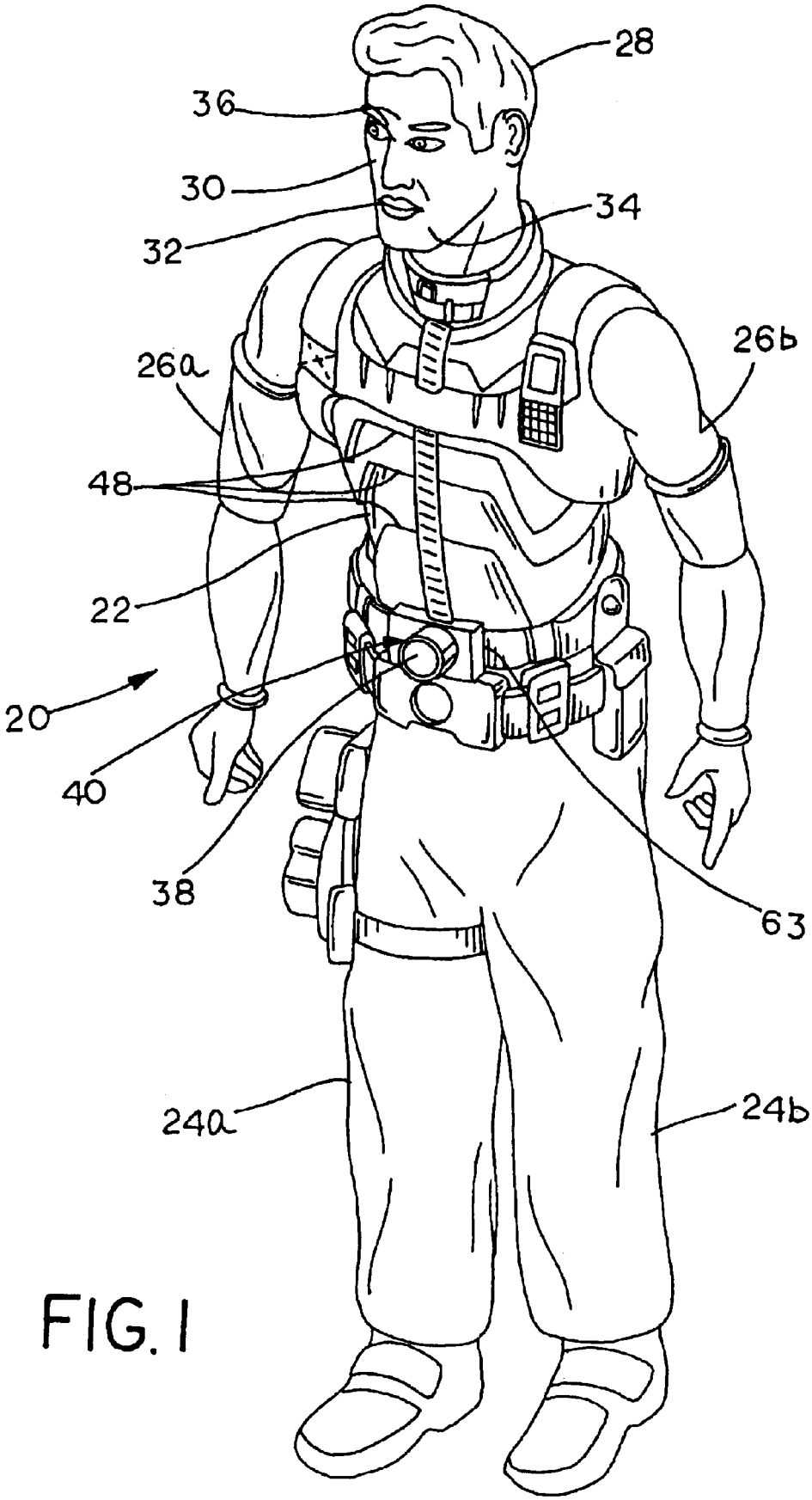
FIG. 1 is a perspective view of one embodiment of a talking action figure toy in accordance with the an aspect of the invention.

Referring now to the drawings, an action figure toy assembled in accordance with the teachings of the present invention is shown in FIG. 1 and is generally referred to by the reference numeral 20. The toy 20 includes a body 22, a pair of legs 24*a*, 24*b*, a pair of arms 26*a*, 26*b*, and a head 28. The head 28 includes a face 30 having a mouth 32, a jaw 34, and a forehead 36. The toy 20 also includes an input button 38 that is operatively connected to an actuator assembly 40 disposed within an interior cavity 42 of the body 22. The toy 20 also includes an electrical circuit 44 and a speaker 46 which are preferably disposed within the interior cavity 42. The body 22 preferably includes a plurality of slots 48 or other apertures such that sounds generated by the speaker 46 are audible from outside the body 22. The toy 20, including the body 22, the legs 24*a*, 24*b*, and the arms 26*a*, 26*b* may be formed using conventional techniques and may include features commonly employed in the art, such as pivotable hands, legs, torso, head, etc.

Figure 2:
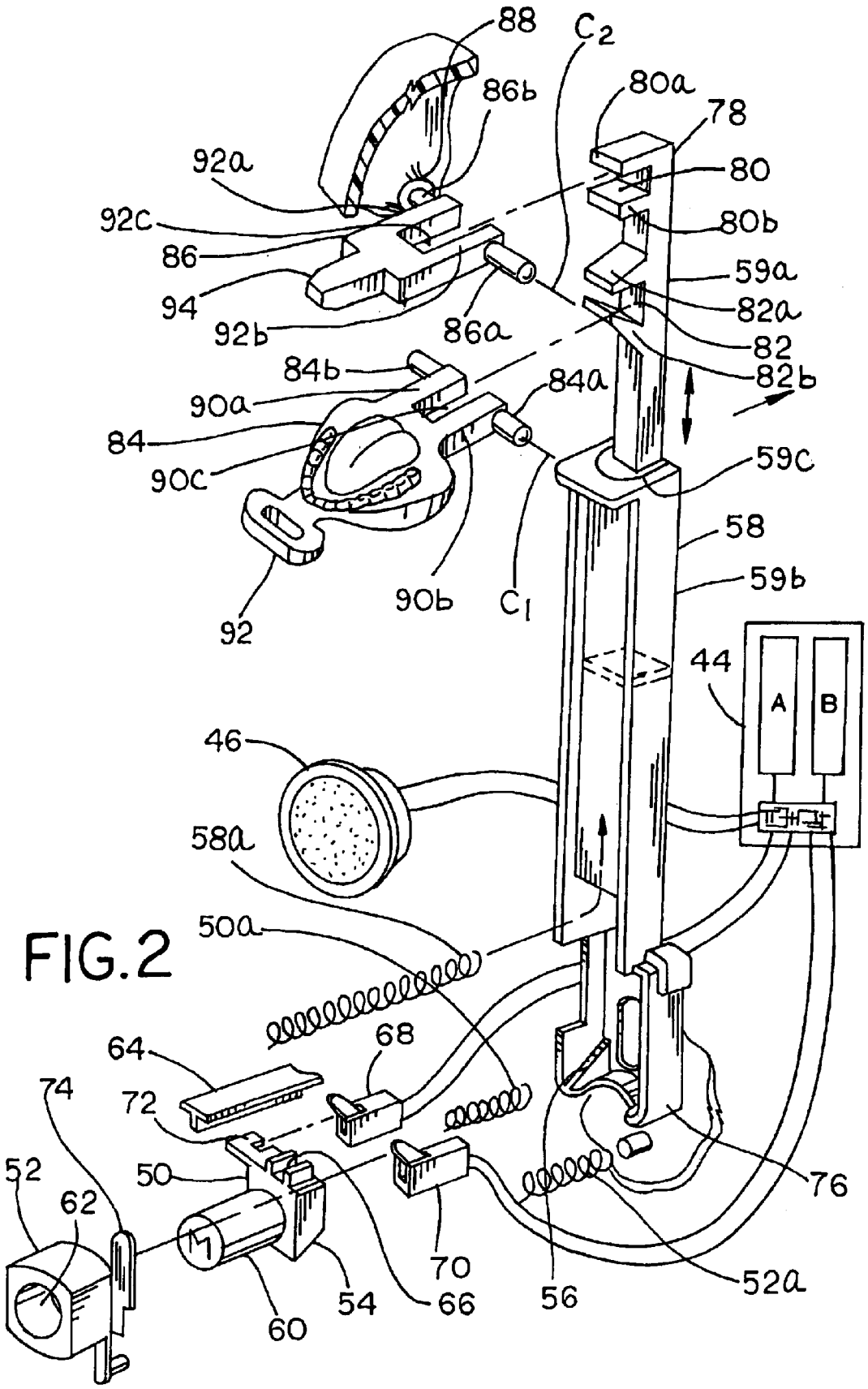
FIG. 2 is an enlarged exploded view in perspective of the actuating assembly.

Referring now to FIG. 2, the actuator assembly 40 is shown in greater detail. The input button 38 includes an inner button 50 and an outer button 52. The inner button 50 includes a camming surface 54 which is adapted to engage a cooperating camming surface 56 on an actuator post 58. The actuator post 58 is slideably disposed within the interior cavity 42 of the body 22. Preferably, the post 58 will include a spring 58*a* which biases the post upwardly. Still preferably, the post 58 may be separable into two pieces 59*a*, 59*b* for purposes of assembly, such as by employing a friction fit connection at 59*c*. The connection 59*c* may be disengaged by sliding the pieces horizontally.

It will be noted that the inner button 50 includes a generally cylindrically shaped protrusion 62 which fits through a corresponding aperture 62 in the outer button 52. Preferably, both the inner and outer buttons 50, 52 are sized to protrude from an opening 63 in the body 22 (see FIGS. 1 and 10–12). In the disclosed example, the interior cavity 42 may be provided with an internal guide rail 64, which engages a suitably sized notch 66 on the inner button 50. Preferably, the buttons 50, 52 are each provided with a spring 50*a*, 52*a*, respectively, so as to bias the buttons 50, 52 generally outward relative to the interior of the body 22 (for example, to the left when viewing FIGS. 10–12). The camming surfaces 54 and 56 are angled at any suitable angle such that, in response to pressing the button 50 inwardly, the rod 58 will shift downwardly along a generally vertical axis.

A pair of switches 68, 70 are mounted within the interior cavity 42 so as to be activated by the input button 38. More specifically, the input button 54 may include a protrusion or tab 72 or other suitable surface which is sized and positioned to activate the switch 68 in response to inward movement of the inner button 50. Similarly, the outer button 52 is provided with a tab or protrusion 74 or other suitable surface which is sized to activate the switch 70 in response to inward movement of the outer button 52. Both of the switches 68, 70 are operatively connected to the electrical circuit 44 in any suitable manner. In turn, the electrical circuit 44 is connected to the speaker 46, such that, upon activation of either of the switches 68, 70, the electrical circuit 44 is activated to produce two separate and distinct speech modes A and B, both of which are audible by virtue of the speaker 46 or other suitable sound generating device.

The post 58 includes a lower end 76 and an upper end 78. The camming surface 56 of the post 58 is defined generally adjacent the lower end 76. The post 58 is preferably sized such that the upper end 78 fits into the head 28 as will be explained in greater detail below. The upper end 78 of the post 58 preferably includes a pair of notches 80, 82, each of which is defined by a pair of cooperating flanges 80*a*, 80*b* and 82*a*, 82*b*, respectively. A pair of levers 84, 86 are disposed within the head 28. The lever 84 includes a pair of pins 84*a*, 84*b* such that the lever 84 will pivot about a pivot axis $C_1$. Similarly, the lever 86 is preferably provide with a pair of pivot pins 86*a*, 86*b* such that the lever 86 will pivot about a pivot axis $C_2$. The head 28 is preferably provided with a suitable number of pivot apertures 88 such that the levers 84, 86 may be mounted within the head 28 such that the levers 84, 86 will pivot in the manner described above. It will be noted when viewing FIG. 2 that in accordance with the disclosed example, at least a portion of the lever 84 is made to resemble a mouth, thus adding to a sense of realism when the facial expression of the toy 20 is changed as will be described below.

The lever 84 includes a pair of posts 90*a*, 90*b* which, in the disclosed example, are spaced apart to define a notch 90*c*. Similarly, the lever 86 includes a pair of posts 92*a*, 92*b*, which are spaced apart to define a notch 92*c*. In the disclosed example, the levers 84, 86 are mounted within the head 28 such that the notch 90*c* engages the notch 82 formed on the post 58, and the notch 92*c* engages the notch 80 formed on the post 58. Accordingly, in response to vertical movement of the post 58, each of the levers 84, 86 will pivot about their respective pivot axes $C_1$ and $C_2$. In the disclosed example, each of the levers 84 and 86 includes an end 92 and 94, respectively.

Thus, in response to downward movement of the post 58, the flange 82*a* will bear against the lever 84, causing the lever 84 to pivot about the axis $C_1$. Similarly, the flange 80*a* will bear against the lever 86, causing the lever 86 to pivot about the axis $C_2$. Accordingly, the ends 92 and 94 will move downward when viewing FIG. 2. In response to upward movement of the post 58, the flange 82*b* will bear against the lever 84, causing the lever 84 to pivot about the axis $C_1$. Similarly, the flange 80*b* will bear against the lever 86, causing the lever 86 to pivot about the axis $C_2$. Accordingly, the ends 92 and 94 will move upward.

Figure 3:
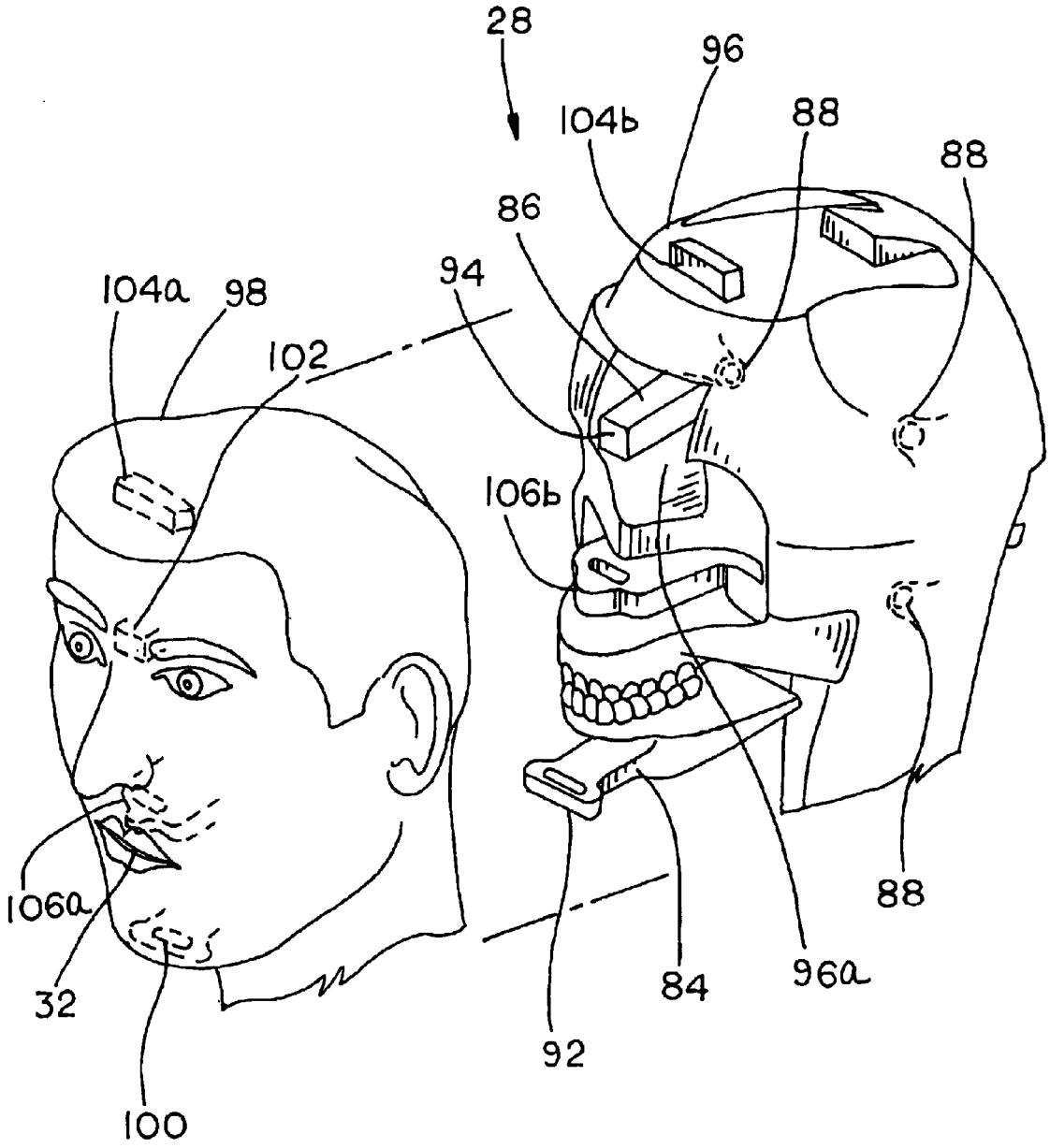
FIG. 3 is an enlarged fragmentary exploded view in perspective of the head including the skull and the flexible skin.

Referring now to FIG. 3, the head 28 preferably includes a skull 96 and a flexible skin 98. The features of the face 30 preferably are formed on the skin 98 using known techniques. In the disclosed example, the skin 98 may be formed of KRATON®, which is commercially available. The skull 96 is preferably formed so as to define an internal cavity 96*a* which is sized to receive the upper end 78 of the post 58. The internal cavity 96*a* of the skull 96 is also sized to receive the levers 84 and 86, with the pins 84*a*, 84*b* and 86*a*, 86*b* (FIG. 2) received in the appropriate pivot apertures 88 inside of the skull 96.

It will be noted that the ends 92 and 94 of the levers 84 and 86, respectively, may be sized to protrude from the interior cavity 96*a* of the skull 96 through suitable openings, so as to engage a portion of the flexible skin 98. The end 92 of the lever 84 may attach to a suitable anchor 100 formed in the skin 98, while the end 94 of the lever 86 may attach to a suitable anchor 102 of the skin 98. In the disclosed example, the skull 96 and the skin 98 may be provided with additional anchors, such at 104*a*, 104*b* adjacent the top of the head 28, and at 106*a*, 106*b* adjacent the middle of the face 30. Accordingly, when the actuator assembly 40 is operated in the manner described in greater detail below, the face will shift between a number of different facial expressions, such as, for example, an undeformed or normal facial expression (FIGS. 3, 4 and 5), a first deformed facial expression (FIGS. 6 and 7), or a second deformed facial expression (FIGS. 8 and 9).

Figure 5:
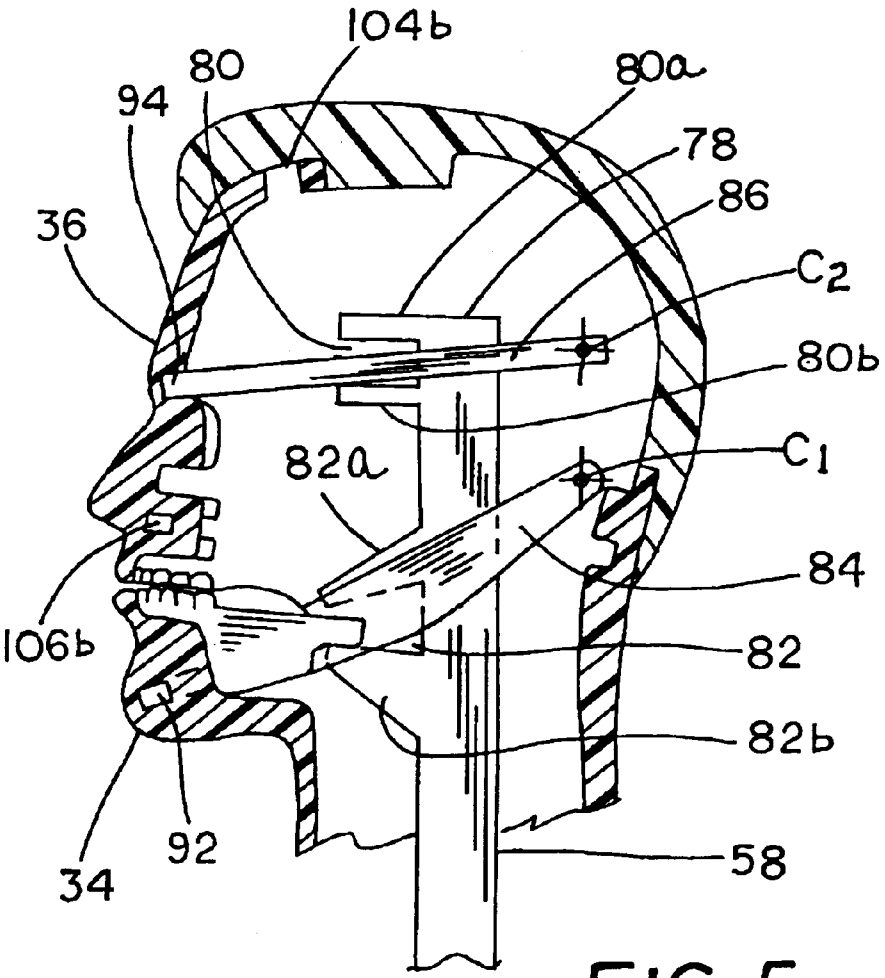
FIG. 5 is a fragmentary cross-sectional view taken along line 5—5 of FIG. 4.
Figure 4:
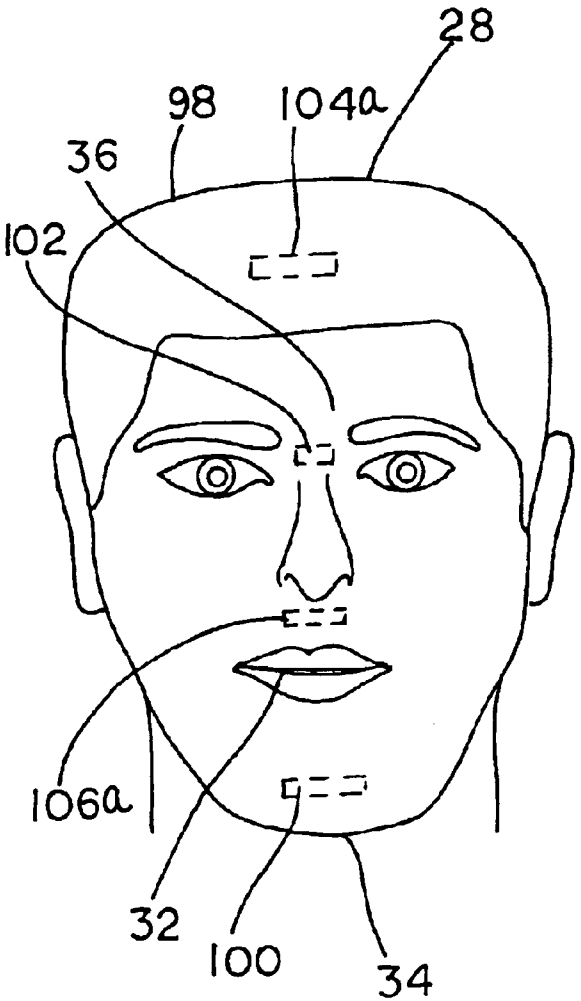
FIG. 4 is an enlarged fragmentary front elevational view illustrating the head of the talking action figure toy.

Referring now to FIGS. 4 and 5, the rod 58 is normally biased upwardly as described above, and thus the ends 92, 94 of the levers 84, 86 are positioned such that the skin 98 is generally not deformed, giving the toy 20 an undeformed or normal facial expression such as that shown in FIG. 4. It will be appreciated that neither of the switches 68 or 70 typically are activated when the toy 20 has the normal facial expression of FIG. 4, and thus the electrical circuit 44 is not activated. It will be noted that in the disclosed example the mouth is closed. It further will he noted when viewing FIG. 5 that the notch 80 is slightly larger than the notch 82, by virtue of the fact that the flanges 80*a* and 80*b* are spaced apart a greater distance than are the flanges 82*a*, 82*b*. This undeformed or normal facial expression corresponds to the position of the actuator assembly 40 and the actuator buttons 50 and 52 as shown in FIG. 10.

Figure 7:
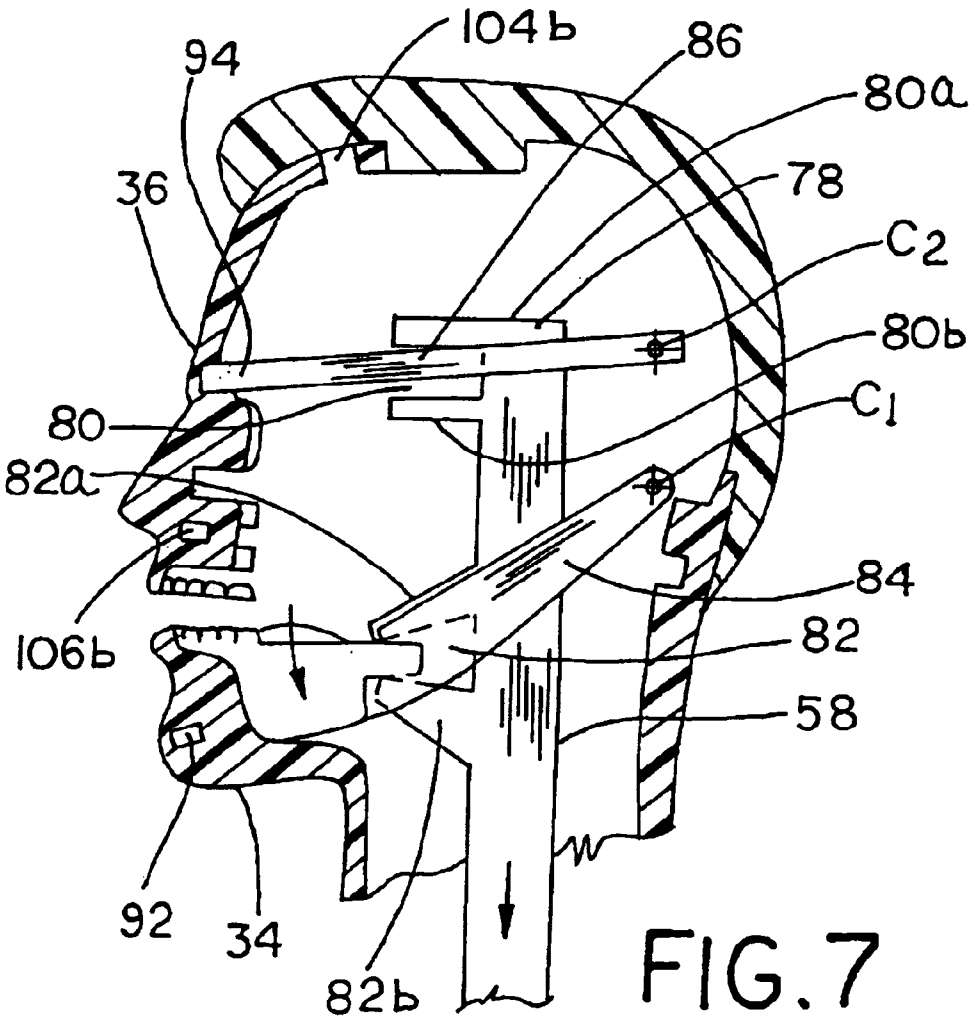
FIG. 7 is a fragmentary cross-sectional view taken along line 7—7 of FIG. 6.
Figure 6:
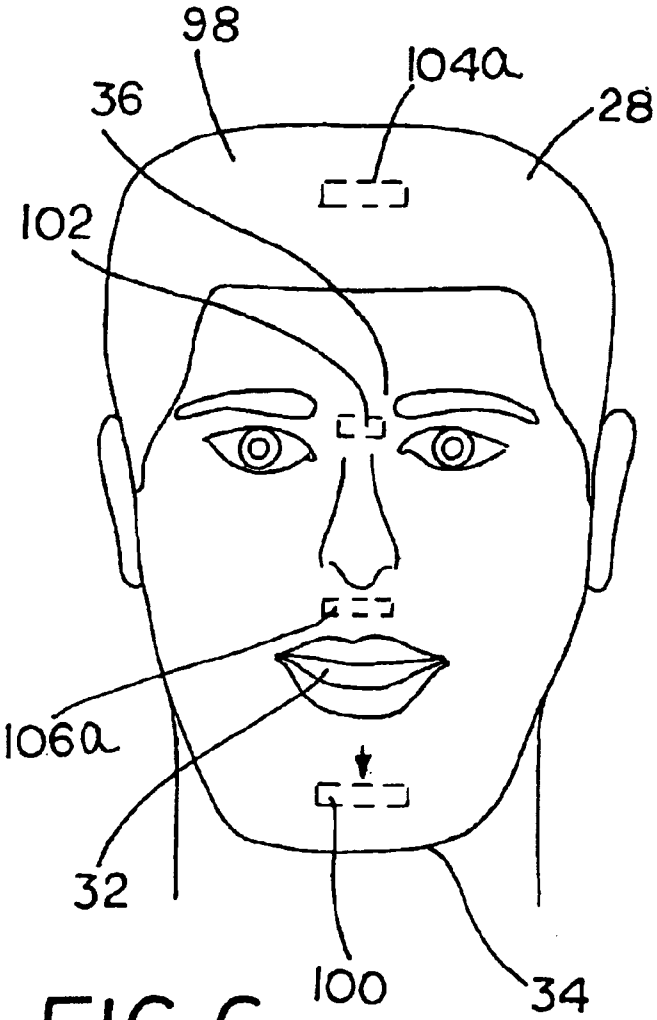
FIG. 6 is an enlarged fragmentary front elevational view similar to FIG. 4 but illustrating a different facial expression.

Referring now to FIGS. 6 and 7, the rod 58 has been shifted downwardly relative to the position shown in FIG. 5 a first distance. It will be understood that this has been accomplished by shifting the actuator assembly 40 and the actuator button 50 to the first shifted position shown in FIG. 11. The end 92 of the lever 84 has been moved downwardly due to rotation of the lever 84 about the axis C, such that the skin is slightly deformed and the mouth is slightly opened, giving the face of the toy 20 a different facial expression than that shown in FIG. 4. It will be noted that due to the larger size of the gap between the flanges 82*a*, 82*b*, the downward movement of the rod 58 is not yet sufficient to bring the flange 80 into contact with the lever 86, and thus the lever 86 remains unrotated. It will be appreciated that the switch 68 may be activated when the toy 20 has the facial expression of FIG. 6, and thus the electrical circuit 44 is activated to produce the speech mode A. This facial expression of FIG. 6 corresponds to the position of the actuator assembly 40 and the actuator buttons 50 and 52 as shown in FIG. 11. The camming surfaces 54 and 56 have cooperated to shift the rod 58 downwardly to rotate the lever 84 as described above. It will be noted that the actuator button 50 has moved inwardly (to the right against the force of the biasing spring 50*a* when viewing FIG. 11), but that the button 52 remains in its initial position similar to that shown in FIG. 10.

Figure 9:
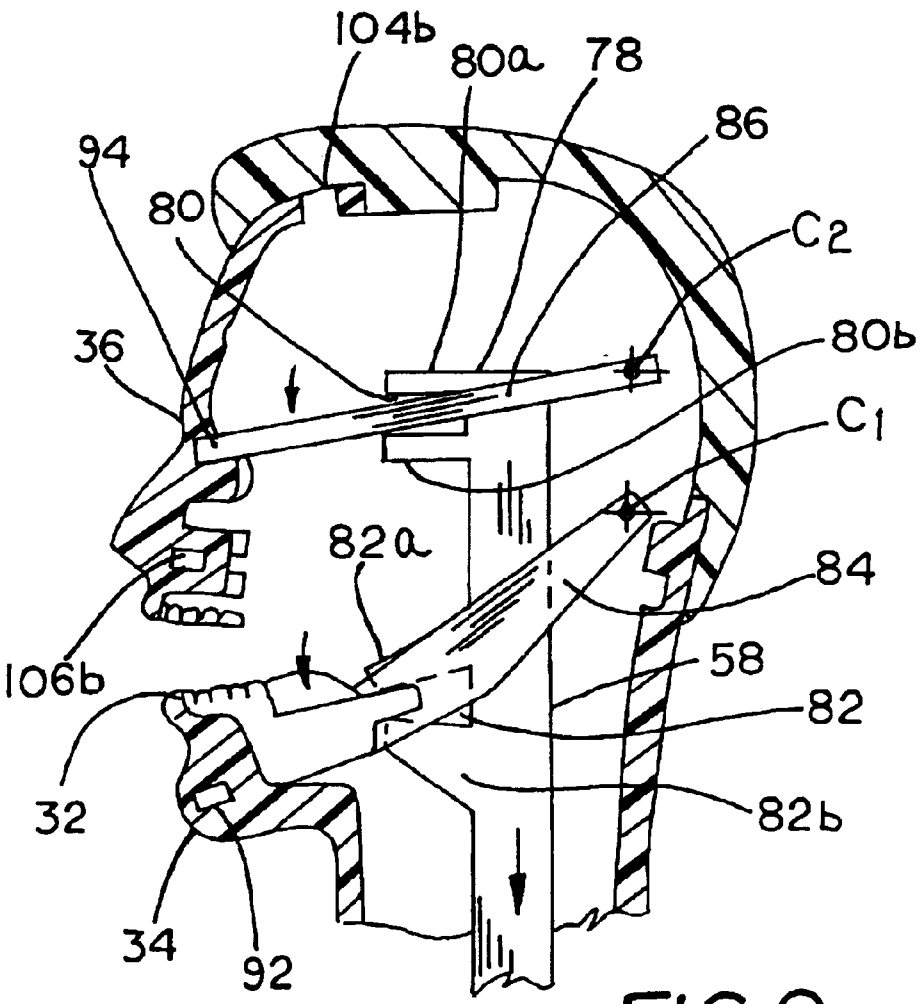
FIG. 9 is a fragmentary cross-sectional view taken along line 9—9 of FIG. 8.
Figure 8:
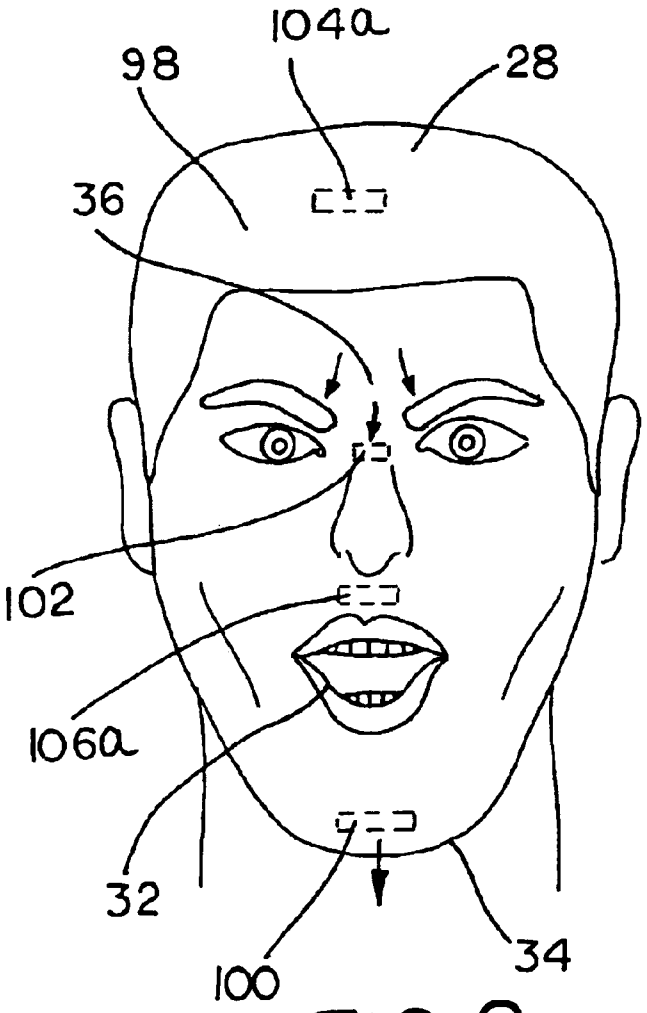
FIG. 8 is an enlarged fragmentary front elevational view similar to FIGS. 4 and 6 but illustrating another different facial expression.
Figure 12:
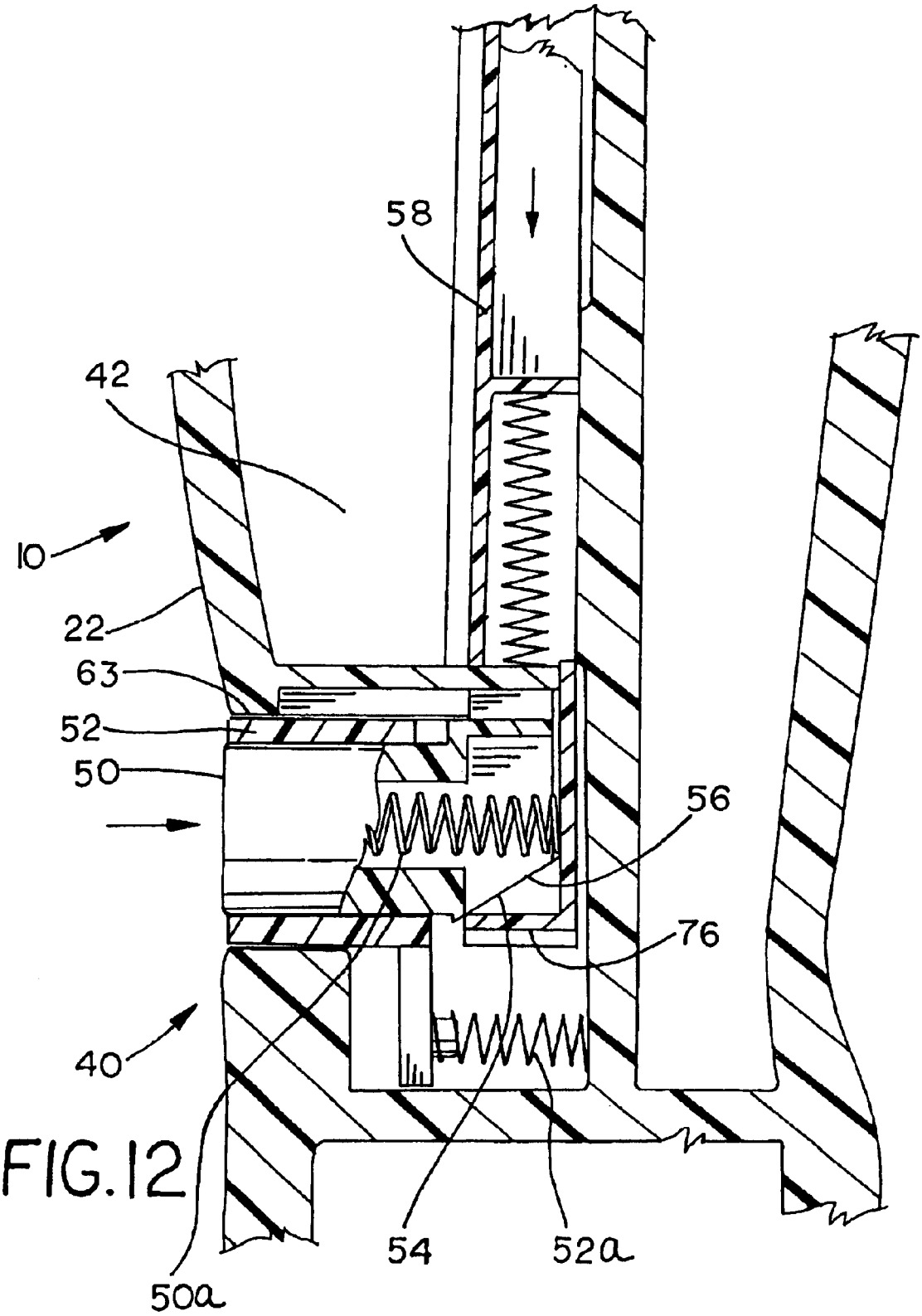
FIG. 12 is an enlarged fragmentary cross-sectional view similar to FIGS. 10 and 11 and illustrating the actuating assembly in another position.

Referring now to FIGS. 8 and 9, the rod 58 has been shifted further downwardly relative to the position shown in FIG. 7. It will be understood that this has been accomplished by shifting the actuator assembly 40 and the actuator button 50 to the second shifted position shown in FIG. 12. The end 92 of the lever 84 has been moved downwardly due to rotation of the lever 84 about the axis $C_1$ such that the skin more deformed and the mouth is more open than that shown in FIG. 6. Further, the rod 58 has now moved downwardly a distance sufficient to also rotate the lever 86, thus deforming the eyebrow area of the face and thus giving the face of the toy 20 a still different and more excited facial expression than that shown in FIG. 6. It will be appreciated that the switch 70 now may have been activated when the toy 20 has the facial expression of FIG. 8, and thus the electrical circuit 44 is activated to produce the more excited speech mode B. This facial expression of FIG. 8 corresponds to the position of the actuator assembly 40 and the actuator buttons 50 and 52 as shown in FIG. 12. The camming surfaces 54 and 56 have cooperated to shift the rod 58 further downwardly to rotate both levers 84 and 86 as described above. It will be noted that both of the actuator buttons 50 and 52 have now moved inwardly (to the right against the force of the biasing springs 50*a* and 52*a* when viewing FIG. 12).

Figure 10:
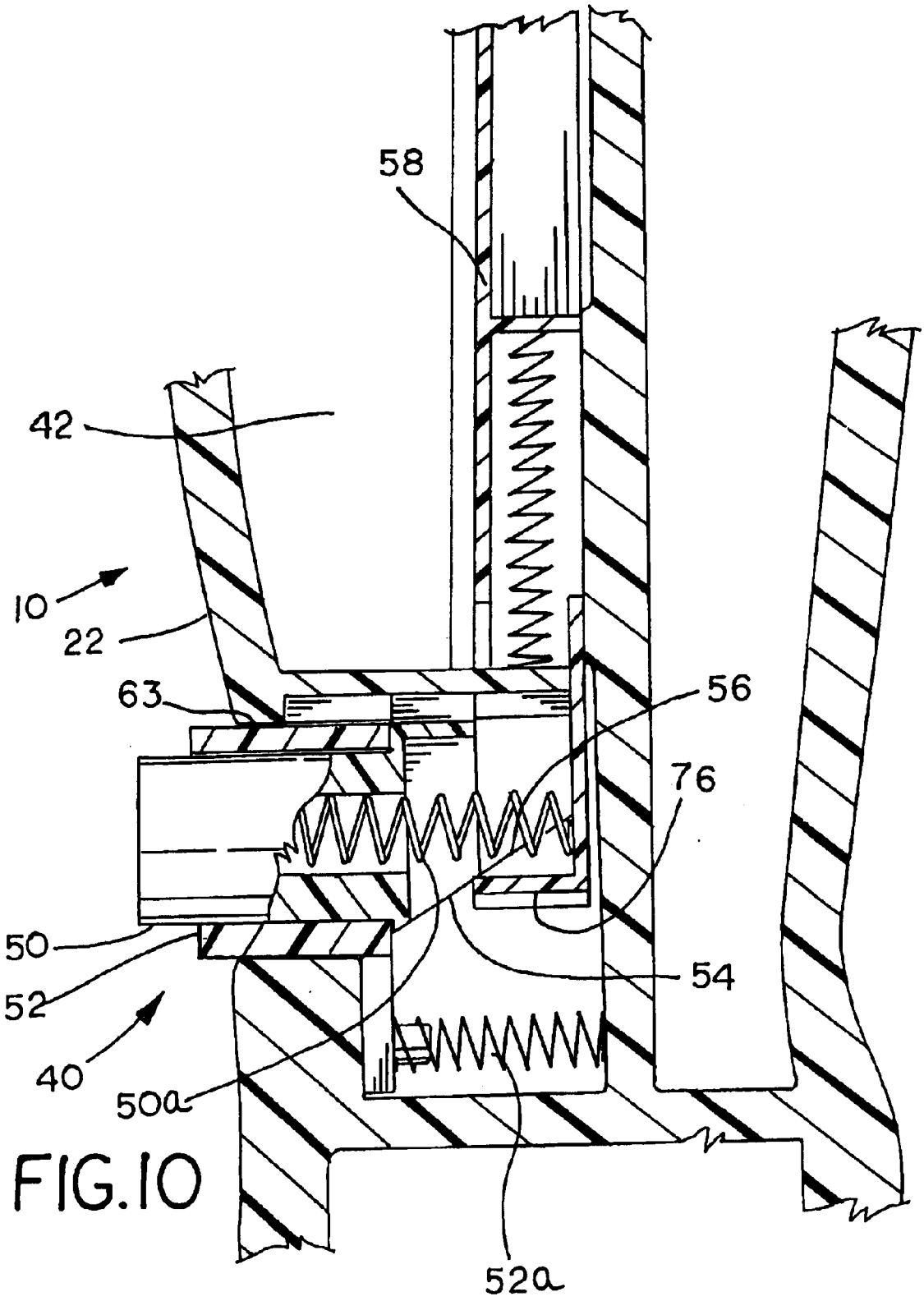
FIG. 10 is an enlarged fragmentary cross-sectional view taken through the middle of the body and illustrating portions of the actuating assembly.
Figure 11:
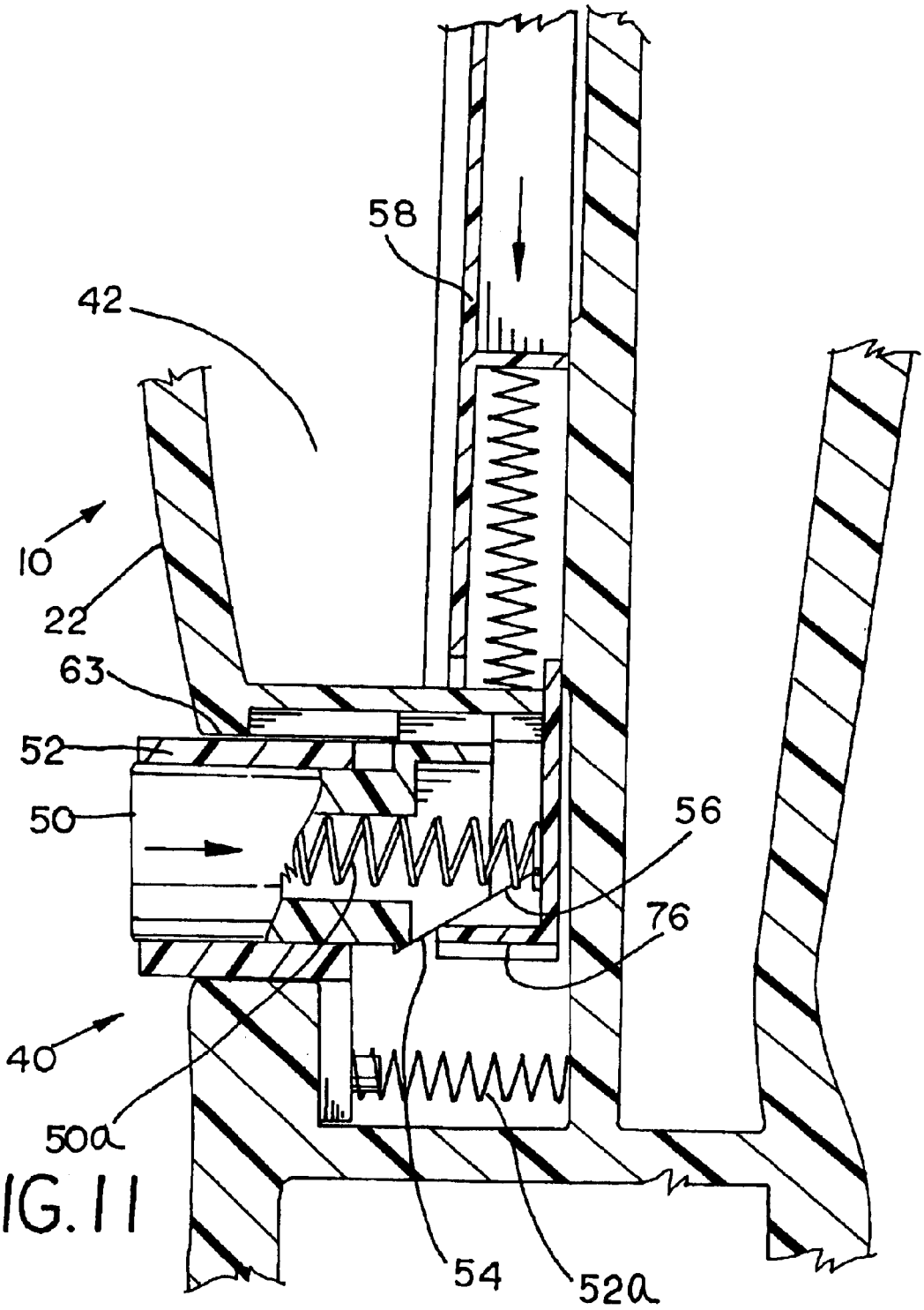
FIG. 11 is an enlarged fragmentary cross-sectional view similar to FIG. 10 and illustrating the actuating assembly in a different position.
Figure 13:
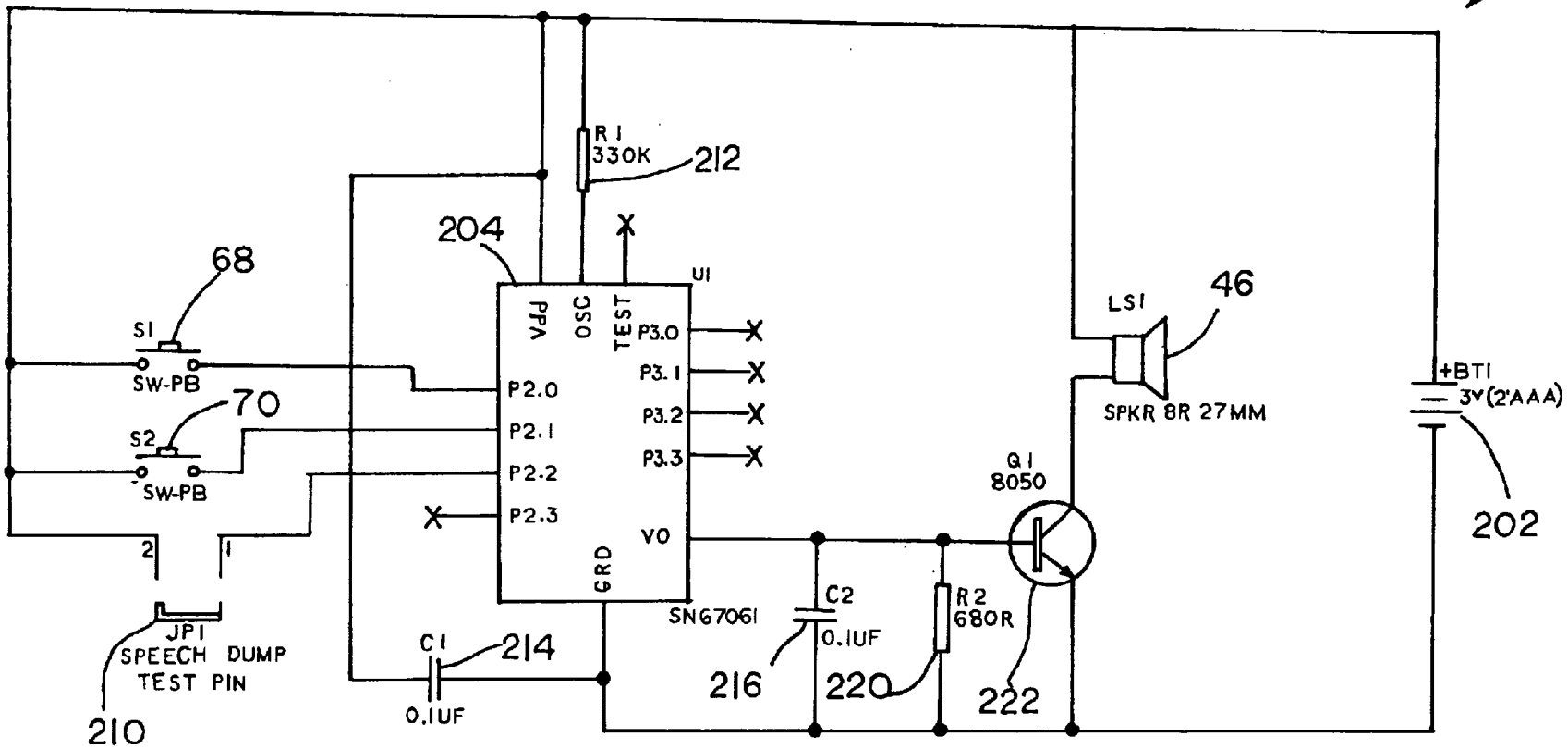
FIG. 13 is a schematic diagram of the speech circuit.
Figure 14:
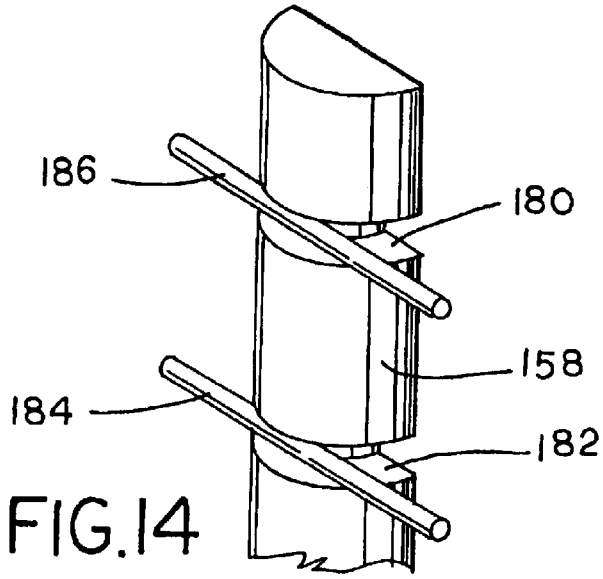
FIG. 14 is an enlarged fragmentary view in perspective illustrating portions of an actuator assembly assembled in accordance with a second disclosed example of the present invention.

It will be understood when viewing FIGS. 11–13 that, due to the fact that the button 50 protrudes through the aperture 62 in the button 52, that typically the outer button 52 cannot be depressed until after the inner button 50 has moved through the first distance from the initial or rest position shown in FIG. 10 to the first shifted position shown in FIG. 11. It will also be understood that, in the disclosed example, a user (not shown) may apply a first force to shift the button 50 to the position of FIG. 11, and may apply a second and greater force in order to shift the buttons 50, 52 to the position of FIG. 12. The spring rates of the springs 50*a*, 52*a* may be selected so as to control the desired amount of force required to shift the buttons 50, 52.

Although it may be possible to move the buttons 50, 52 wholly independently, in normal operation the button 50 will be moved initially, and then both of the buttons 50, 52 will move together. Thus, from the first shifted position of FIG. 11, any additional movement of the inner button 50 will also cause movement of the outer button 52. Consequently, as shown in FIG. 12, both buttons 50, 52 are shifted to the right. Thus, the actuator assembly 40 has an initial position (FIG. 10), a first shifted position (FIG. 11), and a second shifted position (FIG. 12). It will understood from the foregoing that the facial expression of FIG. 7 will be synchronized with or otherwise generally correspond to the speech mode A and the first shifted position of FIG. 11, while the excited facial expression of FIG. 9 will be synchronized with or otherwise generally correspond to the excited speech mode B and the second shifted position of FIG. 12.

FIG. 13 illustrates an exemplary electrical circuit 44 to provide a plurality of speech generation modes. As disclosed in the electrical circuit 44, the Mode A may be provided to generate speech in a normal mode and the Mode B may be provided to generate speech in an elevated mode which, in the disclosed example, is similar to yelling.

The electrical circuit 44 includes a 3V power supply 202 to provide power to a number of electronic components, including a voice synthesizer Integrated Circuit (IC) 204. The voice synthesizer IC 204 includes a programmable micro-controller and a plurality of on-board memory. Specifically, the voice synthesizer IC 204 includes memory having 64*4 bits of Random Access Memory (RAM) and 16K bits of Read Only Memory (ROM). These provide 61 seconds of voice capacity, which may be played at speeds ranging from 2.5 k–20 kHz. Those of ordinary skill in the art will appreciate that many other types of voice synthesizers may alternatively be used.

The voice synthesizer IC 204 is coupled to the power supply 202 via the positive power supply pin $V_{DD}$ The power supply 202 is also coupled to the Bit0 of the I/O port 2 (P2.0) on the voice synthesizer IC 204 via the switch 68. The power supply 202 is coupled to the Bit1 of the I/O port 2 (P2.1) on the voice synthesizer IC 204 via the switch 70. The electronic circuit 44 may be adapted to allow a jumper 210 to be used to supply power to the Bit2 of the I/O port 2 (P2.2) on the voice synthesizer IC 204 to allow for a speech dump test.

The voice synthesizer IC 204 includes an oscillation component connection pin (OSC) that is coupled to the poser supply 202 through a resistor 212. The positive power supply ($V_{DD}$) and the negative power supply (Gnd) on the voice synthesizer IC 204 may be coupled together via a first capacitor 214. The electrical circuit 44 also includes a second capacitor 216 and a second resistor 220 that are coupled in parallel between the negative power supply (GND) and a D/A current output pin ($V_O$) on the voice synthesizer IC 204. The D/A current output pin ($V_O$) on the voice synthesizer IC 204 is provided to drive a transistor 222 for sound output. The transistor 222 is an NPN epitaxial silicon planar transistor with its base connected to the DIA current output ($V_O$), its emitter connected to the poser supply 202 and its collector connected to the speaker 46.

Activating the switch 68 provides a voltage to the Bit0 of I/O port 2, wherein the voice synthesizer IC 204 drives the transistor 222 and the speaker 46 to generate speech in the Mode A. Similarly, activating the switch 70 provides a voltage to the Bit1 of I/O port 2, wherein the voice synthesizer IC 204 drives the transistor 222 and the speaker 46 to generate speech in the Mode B. Preferably, each of the speech modes A and B will be arranged to include a number of words organized into a number of pre-programmed phrases or sentences. Further, preferably that once the appropriate button is activated the speech modes A and B will at least finish each individual word in a sentence of phrase regardless of whether the respective buttons are released. If the user depresses the appropriate button for longer than the duration of an individual word, then the selected speech mode will automatically proceed with the next word in the sentence of phrase until the sentence or phrase is completed. Also, the user may readily switch back and forth between speech modes simply by shifting the actuator assembly 40 and the appropriate buttons 50, 52 between the positions of FIGS. 10, 11 and 12, even in mid-sentence or mid-phrase, all the while having the facial expression synchronized with or otherwise generally corresponding to the speech mode.

Figure 15:
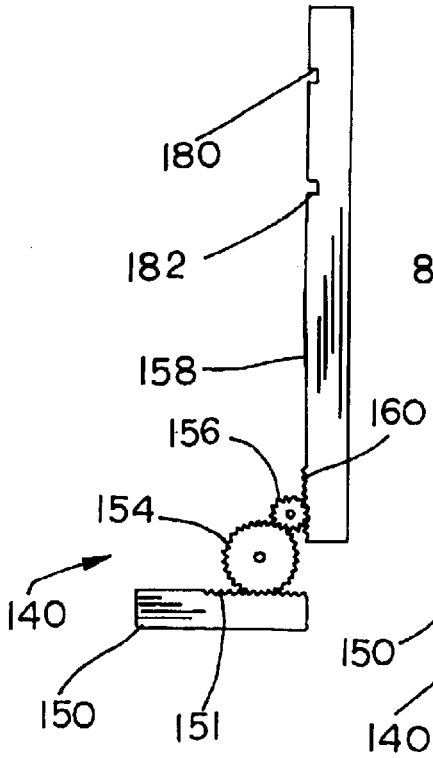
FIG. 15 is an elevational view of portions of an alternative actuator assembly.
Figure 16:
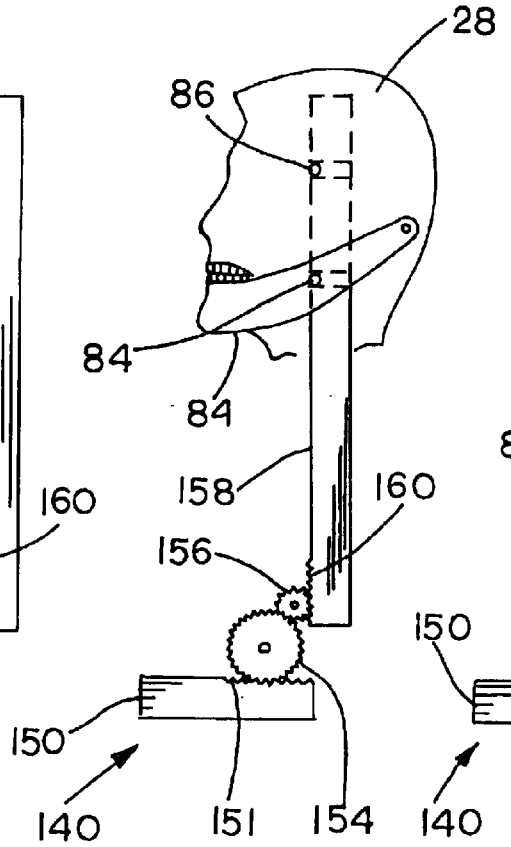
FIGS. 16 and 17 are elevational views similar to FIG. 15 and showing a top portion of the rod disposed inside of the head.
Figure 17:
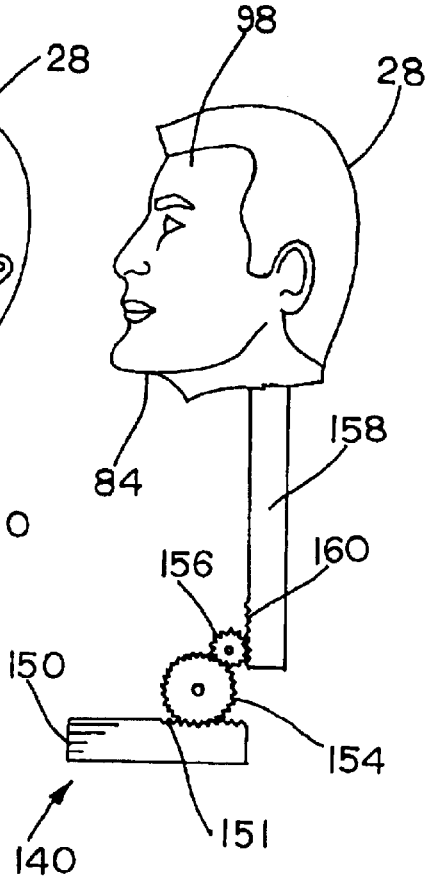
Figure 18:
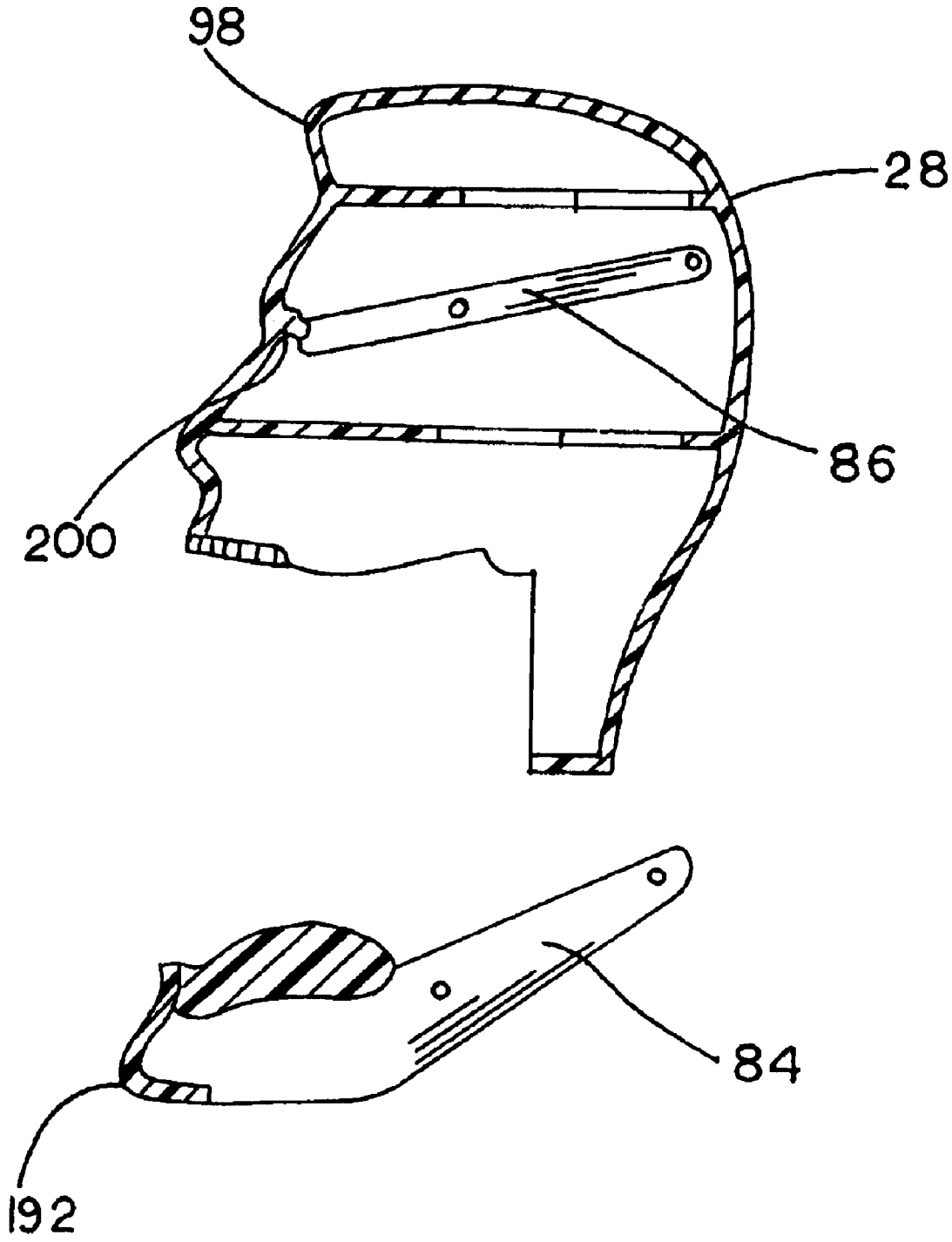
FIG. 18 is an exploded view, partly in section, of the embodiment of FIGS. 14–17.

Referring now to FIGS. 14–18, an alternate form for the actuator assembly 40 is shown and is referred to by the reference numeral 140. A top portion of a rod 158 includes a pair of notches 180, 182, which engage corresponding cross members 184, 186 shown in fragmentary form and which may be connected to the levers 84, 86, respectively, which may be substantially similar to the levers 84, 86 of the type disclosed with respect to the first disclosed example. As shown in FIG. 15, the rod 158 includes a toothed track 160, which is operatively coupled to a toothed track 151 on an actuator button. 150 via a pair of toothed wheels or pinions 154, 156. Accordingly, in response to movement of the button 150 toward the right or left, the rod 158 will move downward or upward, respectively.

The lever 84 includes an end 192 generally forming a jaw, while the lever 86 includes an end 194 connected to a forehead portion of the skin 98 by a tendon 200 sized to have some slack. Accordingly, the eyebrow or forehead portion of the face will not deform until the rod 158 has moved downwardly a distance sufficient to take up the slack in the tendon 200. It will be understood that the embodiment of FIGS. 14–18 may include the sound circuit 44 as described above, and may include other features disclosed above with respect to the first example. Also, the features of the various examples may be interchangeable, and need not be mutually exclusive.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. An action figure toy having synchronized speech and facial expressions and comprising:

a body defining an internal cavity;

a head attached to the body, the head being shiftable between a plurality of facial expressions;

an electrical circuit disposed within the cavity and operatively coupled to a sound generator, the electrical circuit arranged for connection to a power source, the electrical circuit and the sound generator arranged to output an audible first speech mode and an audible second speech mode; and an actuator assembly mounted to the body and operatively coupled to both the head and the electrical circuit, actuator assembly shiftable between a plurality of positions with the head being shiftable in response to movement of the actuator assembly, the actuator assembly arranged to synchronize the first speech mode with a first facial expression and to synchronize the second speech mode with a second facial expression.

2. The action figure toy of claim 1, wherein the actuator assembly includes a rod shiftably disposed within the body and wherein the head includes a pivot lever, an upper part of the rod operatively engaging the pivot lever, the pivot lever shiftable between a first position corresponding to the first facial expression and a second position corresponding to the second facial expression.

3. The action figure toy of claim 2, wherein the head includes a flexible skin, and wherein the pivot lever engages the flexible skin.

4. The action figure toy of claim 1, wherein the head includes a third facial expression.

5. The action figure toy of claim 1, wherein the actuator assembly includes a shiftable input button and a shiftable rod, the rod shiftable in response to movement of the button, the rod operatively connected to the head such that movement of the rod changes the head between the plurality of facial expressions.

6. The action figure of claim 5, wherein the button and the rod are moveable to an unshifted position and wherein the head includes a third facial expression corresponding to the unshifted positions of the button and the rod.

7. The action figure of claim 1, wherein the electrical circuit includes an inactive mode, and wherein the head includes a third facial expression corresponding to the inactive mode.

8. The action figure toy of claim 1, including a first switch and a second switch disposed within the body and operatively coupled to the electrical circuit, the first switch arranged to activate the first speech mode and the second switch arranged to activate the second speech mode.

9. The action figure of claim 8, wherein the actuator assembly includes a input button assembly, the button assembly including a first surface arranged to trigger the first switch in response to movement of the button assembly a first distance, the button assembly including a second surface arranged to trigger the second switch in response to movement of the button assembly a second distance.

10. The action figure of claim 8, wherein the actuator assembly includes a first input arranged to trigger the first switch and a second input button arranged to trigger the second switch.

11. The action figure of claim 10, wherein the second input button is nested within the first input button.

12. The action figure toy of claim 1, wherein the actuator assembly includes a rod shiftably disposed within the body and arranged to shift from a rest position to a first shifted position and to a second shifted position, and wherein the head includes a first pivot lever and a second pivot lever, an upper part of the rod operatively engaging the first and second pivot levers, at least one of the first and second pivot levers arranged to pivot in response to movement of the rod to the first shifted position, the first shifted position corresponding to the first facial expression, the first and second pivot levers arranged to pivot in response to movement of the rod to the second shifted position, the second shifted position corresponding to the second facial expression.

13. The action figure toy of claim 12, wherein the head includes a deformable skin having a jaw and a forehead area, the first pivot lever attached to the jaw, the second pivot lever attached to the forehead area.

14. An action figure toy comprising:

a body defining an internal cavity;

a head attached to the body, the head including a deformable skin and a lever engaging the skin, the skin being deformable in response to movement of the lever such that the skin may be positioned in a plurality of facial expressions;

an actuator moveably mounted within the body and operatively connected to the lever; and an input button mounted to the body and operatively connected to the actuator, the input button shiftable to a first position corresponding to a first facial expression and to a second position corresponding to a second facial expression.

15. The action figure toy of claim 14, including an electrical circuit disposed within the cavity and operatively coupled to a sound generator, the electrical circuit arranged for connection to a power source, the electrical circuit and the sound generator arranged to output an audible first speech mode synchronized with the first facial expression and an audible second speech mode synchronized with the second facial expression.

16. The action figure toy of claim 15, the electrical circuit including an inactive mode synchronized with an undeformed facial expression.

17. The action figure toy of claim 15, including a first switch and a second switch disposed within the body and operatively coupled to the electrical circuit, the first switch arranged to activate the first speech mode in response to movement of the input button a first distance, and the second switch arranged to activate the second speech mode in response to movement of the input button a second distance.

18. The action figure of claim 17, wherein the input button includes an inner button and an outer button, and wherein the outer button is arranged to remain stationary until the inner button has traveled the first distance.

19. The action figure toy of claim 14, wherein the actuator is arranged to shift from a rest position to a first shifted position and to a second shifted position, the rest position corresponding to an undeformed facial expression.

20. The action figure toy of claim 19, including an electrical circuit disposed within the cavity and operatively coupled to a sound generator, the electrical circuit arranged for connection to a power source, the electrical circuit and the sound generator arranged to output an audible first speech mode synchronized with the first facial expression and an audible second speech mode synchronized with the second facial expression, the electrical circuit further including an inactive mode corresponding to the undeformed facial expression.

21. The action figure toy of claim 14, the head including a second lever engaging the skin, the actuator operatively engaging the first and second levers, the first lever arranged to deform a first part of the skin in response to movement of the input button to the first position, the second pivot lever arranged to deform a second part of the skin in response to movement of the input button to the second position.

22. The action figure toy of claim 21, wherein the head includes a jaw and a forehead area, the first pivot lever attached to the jaw, the second pivot lever attached to the forehead area.

23. An action figure toy having synchronized speech and facial expression comprising:

a body defining an internal cavity;

a head attached to the body, the head including a deformable skin and a lever engaging the skin, the skin being deformable in response to movement of the lever such that the skin may be positioned in a plurality of facial expressions;

a post vertically shiftable within the body and extending to the head, the post and operatively connected to the lever; and an input button mounted to the body and operatively connected to the actuator, the input button shiftable to a first position corresponding to a first facial expression and to a second position corresponding to a second facial expression; and an electrical circuit disposed within the cavity and operatively coupled to a sound generator, the electrical circuit arranged for connection to a power source, the electrical circuit and the sound generator arranged to output an audible first speech mode synchronized with the first facial expression and an audible second speech mode synchronized with the second facial expression.

24. An action figure toy comprising:

a body defining an internal cavity;

an input button mounted to the body and extending into the cavity, the input button shiftable from a rest position to a first shifted position in response to the application of a first force, the input button further shiftable to a second shifted position in response to application of a second force greater than the first force; and an electrical circuit disposed within the cavity and operatively coupled to a sound generator, the electrical circuit arranged for connection to a power source, the electrical circuit operatively coupled to the input button and arranged to output an audible first speech mode in response to the application of the first force, and further arranged to output an audible second speech mode in response to the application of the second force.

25. The toy of claim 24, including a head attached to the body, the head including a face deformable into a plurality of facial expressions, and further including an actuator coupled to the input button, the actuator arranged to shift the face to a first facial expression synchronized with the first speech mode and to a second facial expression synchronized with the second speech mode.

26. The toy of claim 24, wherein electrical circuit includes a voice synthesizer, the voice synthesizer programmed such that the first speech mode resembles normal speech and so that the second speech mode resembles excited speech.

27. The toy of claim 25, wherein the head includes a deformable skin, and including a lever disposed inside the head and engaging the skin, the lever responsive to movement of the actuator.

* * * * *